US007841090B2

(12) United States Patent
Eichhorn et al.

(10) Patent No.: US 7,841,090 B2
(45) Date of Patent: Nov. 30, 2010

(54) ELECTRIC SHAVER

(75) Inventors: Reinhold Eichhorn, Idstein (DE); Detlef Gleich, Friedrichsdorf (DE); Peter Junk, Schmitten (DE); Christof Kleemann, Eschborn (DE); Michael Odemer, Niddatal (DE); Thorsten Pohl, Muehlheim (DE); Tobias Schwarz, Schmitten (DE); Thomas Verstege, Frankfurt am Main (DE); Martin Vitt, Frankfurt am Main (DE); Juergen Wolf, Kriftel (DE); Christoph Zegula, Roedermark (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/348,584

(22) Filed: Jan. 5, 2009

(65) Prior Publication Data

US 2009/0133263 A1 May 28, 2009

Related U.S. Application Data

(63) Continuation of application No. PCT/EP2007/004438, filed on May 18, 2007.

(30) Foreign Application Priority Data

Jul. 5, 2006 (DE) ..... 10 2006 030 947

(51) Int. Cl.
*B26B 19/04* (2006.01)

(52) U.S. Cl. ..... 30/43.92; 30/346.51

(58) Field of Classification Search ..... 30/34.1, 30/43.9, 43.91, 43.92, 346.51
See application file for complete search history.

(56) References Cited

U.S. PATENT DOCUMENTS

| | | | | | |
|---|---|---|---|---|---|
| 3,136,055 | A | * | 6/1964 | Kobler et al. | 30/43.1 |
| 4,796,359 | A | * | 1/1989 | Oprach et al. | 30/43.92 |
| 4,797,997 | A | * | 1/1989 | Packham et al. | 30/43.92 |
| 4,930,217 | A | * | 6/1990 | Wolf et al. | 30/43.92 |
| 4,941,259 | A | * | 7/1990 | Wolf | 30/34.1 |
| 5,185,926 | A | * | 2/1993 | Locke | 30/43.92 |
| 5,189,792 | A | * | 3/1993 | Otsuka et al. | 30/43.92 |
| 5,410,811 | A | * | 5/1995 | Wolf et al. | 30/43.9 |
| 5,611,145 | A | * | 3/1997 | Wetzel et al. | 30/43.92 |
| 5,704,126 | A | | 1/1998 | Franke et al. | |

(Continued)

FOREIGN PATENT DOCUMENTS

| | | |
|---|---|---|
| DE | 36 10 736 | 10/1987 |

(Continued)

*Primary Examiner*—Hwei-Siu C Payer
(74) *Attorney, Agent, or Firm*—Brent M. Peebles; Jay Anthony Krebs

(57) ABSTRACT

The present invention is directed to an electric shaver having a shaver housing, and a shaving head housing that is connected to the shaver housing for pivotal movement between two end positions. The shaving head housing carries at least two shaving assemblies, of which at least one shaving assembly is retractable into the housing to a first, retracted position, and elastically biased toward a second, extended position, such that extension of the at least one shaving assembly is a function of contact pressure applied by a user. Actuating elements carried by the shaving head housing control a maximum degree of extension of the at least one shaving assembly as a function of a pivot angle between the shaver housing and the shaving head housing.

12 Claims, 5 Drawing Sheets

U.S. PATENT DOCUMENTS

| | | | | |
|---|---|---|---|---|
| 6,357,118 | B1 * | 3/2002 | Eichhorn et al. | 30/43.92 |
| 6,481,103 | B2 * | 11/2002 | Van Hout et al. | 30/34.1 |
| 7,162,801 | B2 * | 1/2007 | Royle | 30/43.92 |

FOREIGN PATENT DOCUMENTS

| | | | |
|---|---|---|---|
| DE | 42 44 164 | | 9/1995 |
| DE | 692 24 440 | | 6/2002 |
| EP | 0 302 268 | | 2/1989 |
| EP | 1 403 011 | | 4/2004 |
| WO | WO 2008/003370 | A1 * | 1/2008 |

* cited by examiner

ELECTRIC SHAVER

CROSS-REFERENCE TO RELATED APPLICATIONS

This application is a continuation application of and claims priority to PCT Application Serial No. PCT/EP2007/004438, filed on May 18, 2007, through which priority is claimed under 35 U.S.C. §119(a) from German patent application number 10 2006 030 947.2, filed Jul. 5, 2006. The entire contents of PCT Application Serial No. PCT/EP2007/004438 are incorporated herein by reference.

TECHNICAL FIELD

This invention relates to an electric shaver with a pivotally mounted shaving head housing.

BACKGROUND

German patent application publication DE 36 10 736 A1 provides a dry shaver that includes a housing and a shaving head housing pivotable relative to the housing about a fixed pivotal axis. This shaving head housing accommodates two shaving assemblies extending parallel to one another and capable of linear oscillation, which, owing to the capability of the shaving head housing to pivot, are in a position to conform themselves optimally to the skin surface regardless of the housing's alignment condition relative to the skin surface, so that both shaving assemblies engage the skin always simultaneously, independent of the angle at which the shaver housing is held against the skin. In addition, because the two shaving assemblies are supported in the shaving head housing by a coupling block spring-loaded in vertical direction, they can react to the contact pressure applied by the user by a corresponding retracting movement, which causes the shearing plane to be lowered relative to the shaving head housing at least temporarily. For optimum conformance of the shaving assemblies to the skin to be shaved, it is of particular importance for the shaving head housing to be freely pivotable about the defined pivotal axis. Considering that the drive mechanism arranged in the housing needs to be coupled to the shaving assemblies at all times, the maximum possible pivotal range of the shaving head housing relative to the housing is limited. Embodiments of such dry shavers reduced to practice have a maximum pivotal range of less than 40°, that is, barely 20° from a mid-position in clockwise direction, and 20° in counterclockwise direction.

SUMMARY

According to one aspect of the invention, an electric shaver includes a shaver housing, and a shaving head housing that is connected to the shaver housing for pivotal movement between two end positions. The shaving head housing carries at least two shaving assemblies, of which at least one shaving assembly is retractable into the housing to a first, retracted position, and elastically biased toward a second, extended position, such that extension of the at least one shaving assembly is a function of contact pressure applied by a user. Actuating elements carried by the shaving head housing control a maximum degree of extension of the at least one shaving assembly as a function of a pivot angle between the shaver housing and the shaving head housing.

In some embodiments, the at least one shaving assembly is moved by the actuating elements at least partly towards the retracted position, when the at least one shaving assembly is a leading shaving assembly relative to a pivot direction.

In some embodiments, the at least two shaving assemblies have respective longitudinal axes extending parallel to one another and parallel to a pivotal axis of the shaving head housing, with the shaving assemblies being configured as linearly oscillating assemblies. In some arrangements, oscillation occurs along the respective longitudinal axes.

In some embodiments, the at least two shaving assemblies are floating-mounted in the shaving head housing.

In some embodiments, the at least two shaving assemblies each include an outer cutter and an under cutter biased into contact therewith.

In some embodiments, the actuating elements include at least one pivotable control lever that pivots in response to a pivotal movement of the shaving head housing relative to the shaver housing.

In some embodiments, a first arm of the control lever is acted upon by a stop, and a second arm of the control lever is coupled to at least one of the shaving assemblies.

In some embodiments, the at least one shaving assembly acts on another shaving assembly during at least a portion of a retraction stroke.

In other embodiments, the shaving head housing is lockable at a defined pivot angle with respect to the shaver housing. In some arrangements, the defined pivot angle is a maximum pivot angle.

In some cases, the shaving assemblies are arranged in an exchangeable frame adapted to be locked with the shaving head housing.

In some arrangements, an exchangeable frame is connectable to the shaving head housing, wherein the shaving assemblies are displaceably mounted in the exchangeable frame.

In some embodiments, the electric shaver is provided as a dry shaver.

Various embodiments described herein feature a shaving assembly that is biased towards a retracted position based on a contact pressure applied by a user, as well as actuating elements that control a maximum extension of the shaving assembly as a function of a pivot angle between a shaver housing and a shaving head housing.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
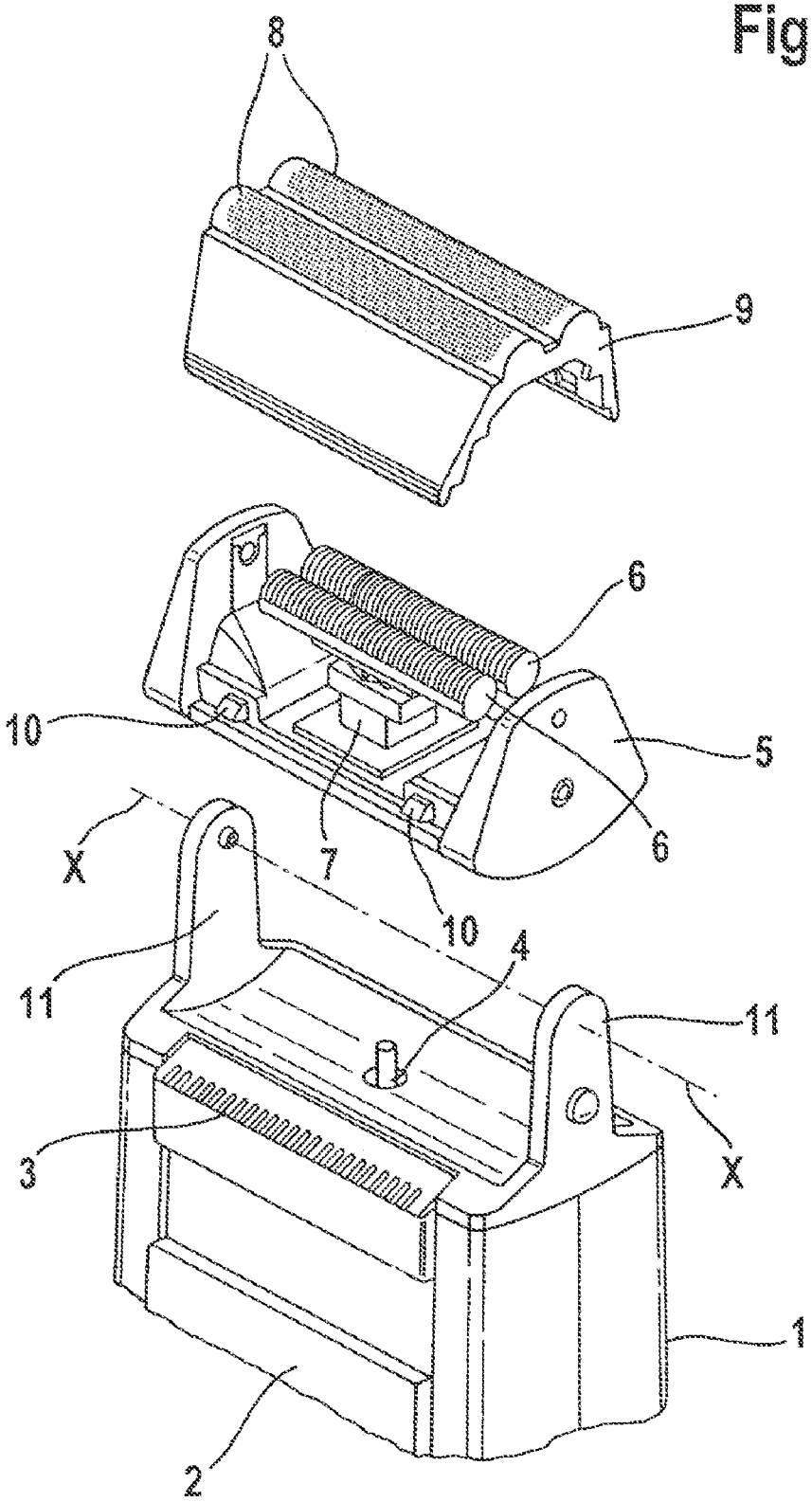
FIG. 1 is a view of the basic construction of a shaver including plural shaving assemblies which are arranged in a pivotal shaving head housing.

FIG. 1 shows in a perspective representation the basic construction of a shaver with a pivotal shaving head, including a housing 1 accommodating an electric drive mechanism and, as the case may be, single-use or rechargeable batteries or the like. Arranged on the housing 1 is an on/off switch 2 and, as the case may be, a trimmer 3 for shortening relatively long hair. Projecting from the upper end of the housing 1 is a drive element 4 which is coupled to the motor. A shaving head housing 5 receives under cutters 6 which are constructed to include cutter blocks having a plurality of blades extending in a direction transverse to the direction of oscillation. The under cutters 6 are held by a coupling element 7 which in turn is connected to the drive element 4. Outer cutters constructed as perforated foils 8 are held in a frame 9 which is connectible to the shaving head housing by catch elements 10, for example. The shaving head housing 5 in turn is mounted on holding arms 11 of the housing for pivotal movement about an axis X-X, for which purpose both the holding arms 11 and the shaving head housing 5 include suitable bearing points. With the drive mechanism activated, the under cutters 6 are caused to oscillate along their longitudinal axis and are thus operable in cooperation with the associated shaving foil 8 to cut off hairs extending through the perforations in the shaving foil. To accomplish this, it is necessary for the under cutter 6 to be always pressed into engagement with the shaving foil 8, for which purpose the under cutters 6 are loaded by compression springs, not illustrated, which are seated between the shaving head housing or a component connected thereto and the under cutters. In addition, the two shaving assemblies each of which includes an under cutter 6 and a shaving foil 8 are mounted in the shaving head housing 5 in a way enabling them to perform a receding motion in vertical direction according to the drawing, whose magnitude is in turn dependent on the contact pressure applied by the user. The floating suspension enables the shaving assemblies to conform themselves closely to the skin contours to be shaved. Furthermore, the capability of the shaving head housing 5 to pivot with respect to the housing 1 enables both shaving assemblies to make optimum engagement with the skin simultaneously, regardless of the angular position of the housing relative to the skin.

Figure 2:
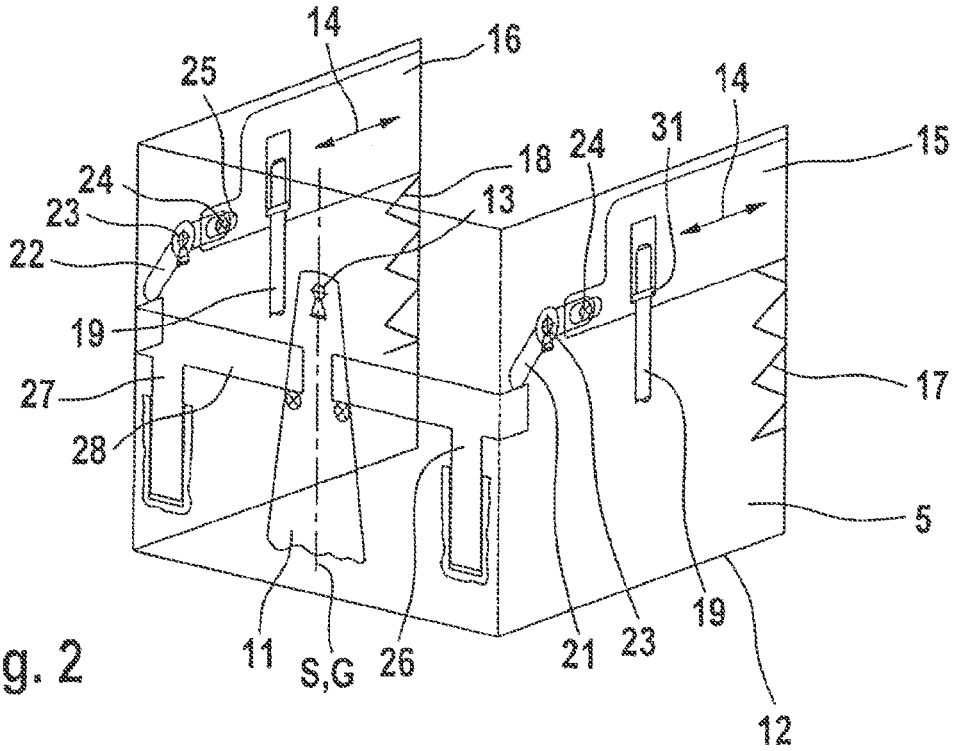
FIGS. 2 to 5 are various schematic views of the pivotal shaving head of a shaver of the invention.
Figure 3:
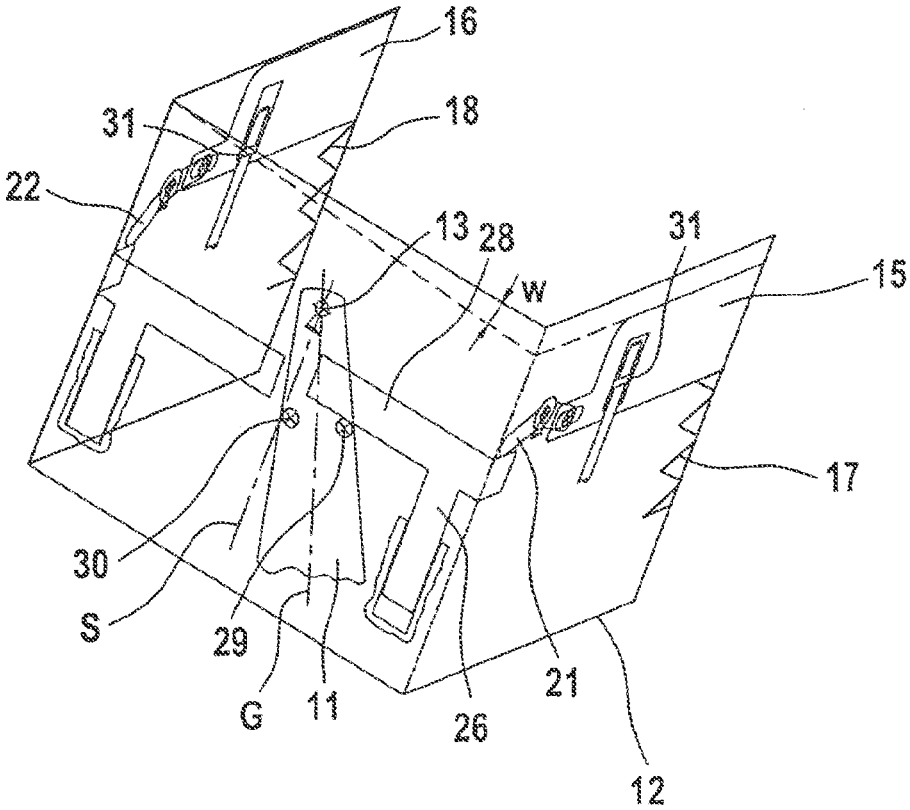
Figure 4:
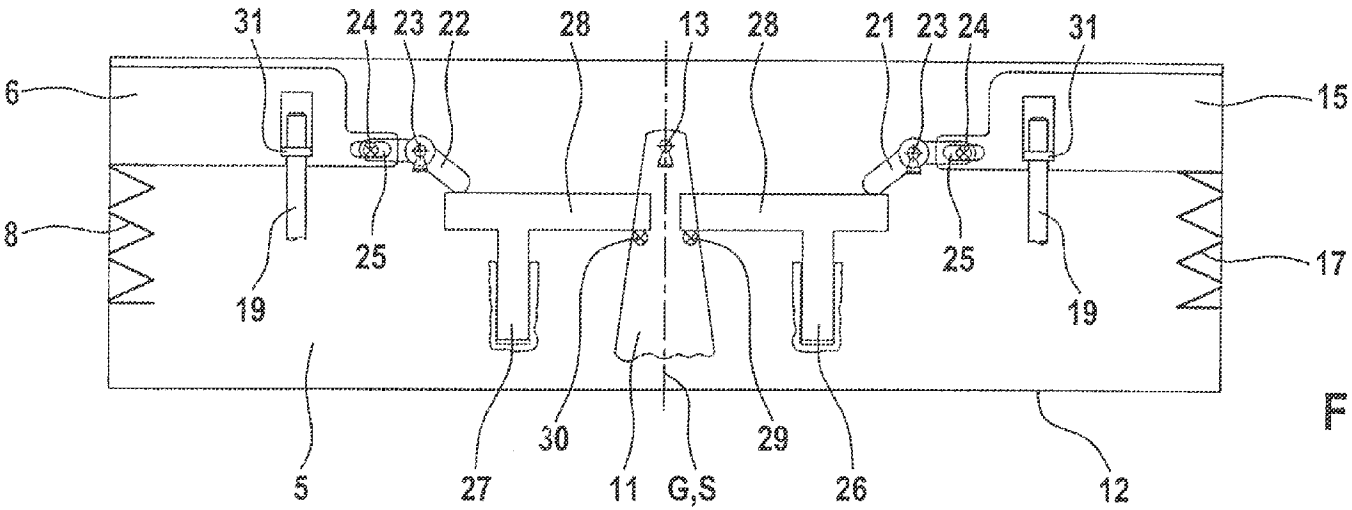
Figure 5:
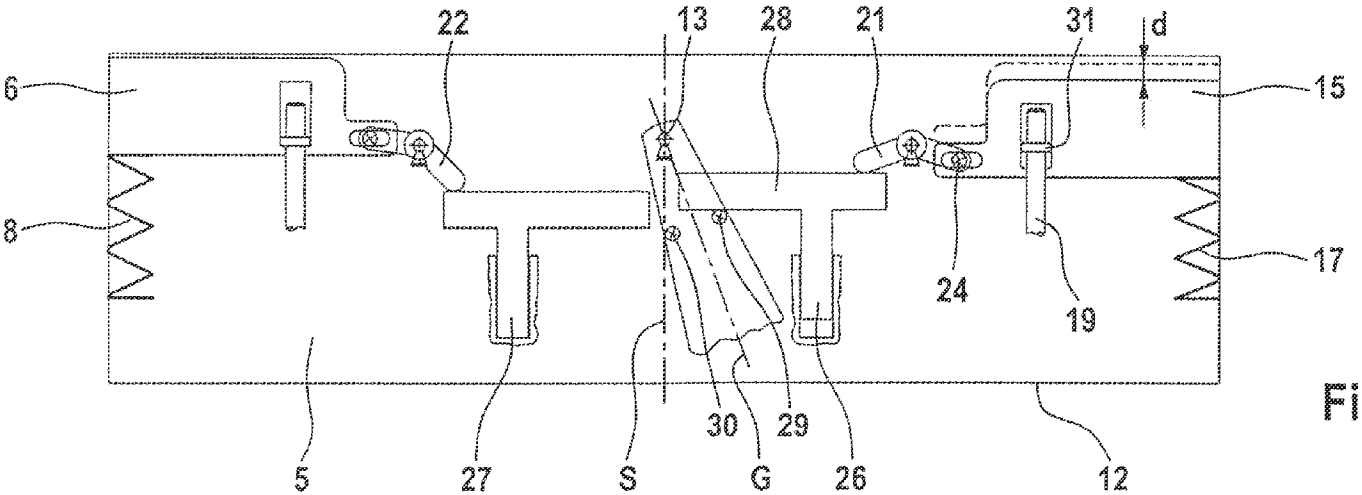

FIGS. 2 and 3 are greatly simplified and schematic views of the kinematics of the shaving head of the shaver of the invention. FIG. 2 shows the shaving head roughly in a mid-position relative to the housing 1, while FIG. 3 shows the shaving head housing 5 pivoted relative to the housing 1 to its maximum pivotal position. FIGS. 4 and 5 correspond to FIGS. 2 and 3, respectively, showing however the shaving assemblies unfolded outwardly into the plane of projection through an angle of 90° for better clarity of illustration of the shaving head mechanics as a two-dimensional representation.

In FIGS. 2 to 5, the shaving head housing 5 is illustrated by a box-shaped or rectangular element 12 and is freely pivotally connected to the holding arms 11 by bearing points 13. For the sake of clarity of illustration, FIGS. 2 to 5 show only part of the shaving head; the remaining part of the shaving head is cut away by a cut extending perpendicularly to the longitudinal axes (see double arrows 14) of the shaving assemblies 16 and 15. The whole shaving head 5 is however symmetrical to this cut-away area. Each of the shaving assemblies 15 and 16 shown in a simplified and schematic representation is composed of an outer cutter and an under cutter which are driven to oscillate relative to each other in accordance with the double arrows 14. The details of the shaving assemblies 15, 16 and the drive mechanism of these elements is not illustrated in the Figures, but they include preferably an under cutter and an outer cutter biased into relative engagement and adapted to be driven to oscillate, with each shaving assembly being assembled in a prior operation as a complete module. This module in turn is floating-mounted in the shaving head housing by compression springs and suitable guides. The shaving assemblies 15, 16 are slidably mounted in the shaving head housing 5 by vertically oriented guide bolts and are biased vertically upwardly by compression springs 17 and 18, respectively. The shaving assemblies are thus floating-mounted within the pivotal shaving head housing, in particular within an exchangeable frame (37, see FIG. 6 or 7). The guide bolts 19 which have their downwardly pointing ends secured in the shaving head housing 5 extend parallel to a center line S of the shaving head housing.

Control levers 21, 22 are pivotally mounted by respective pivot bearings 23 in an exchangeable frame securable in the shaving head housing 5, which frame also accommodates the shaving assemblies 15, 16 and, as the case may be, the compression springs 17, 18. In this arrangement, the control lever 21 is associated with the shaving assembly 15 and the control lever 22 with the shaving assembly 16. The control levers 21, 22 are two-armed levers and include on their arms associated with the respective shaving assemblies 15 and 16 a respective follower 24 which engages in a corresponding elongated hole 25 of the associated shaving assembly. The other arm of the control lever 21 and 22 is associated with a control slide 26 and 27, respectively, which are vertically slidably mounted in the shaving head housing. In this arrangement, the direction of displacement of the control slides 26, 27 is parallel to the center line S or to the longitudinal axis of the guide bolts 19.

The control slides 26 and 27 are arranged in juxtaposition with the holding arms 11 and possess follower arms 28 extending in the direction of the associated holding arm 11, accordingly in a direction transverse to the center line S. The follower arms 28 and hence the control slides 26, 27 can be raised by associated control trunnions 29 and 30, respectively, depending on the pivotal movement of the shaving head housing 5 relative to the housing 1 or relative to the center line G.

When the shaving head 5 is in a mid-position as illustrated in FIGS. 2 and 4 and no external load is applied to the shaving assemblies 15, 16, these are urged upwardly against stops 31 of the guide bolts 19 by the compression springs 17, 18 in the interior of the shaving head housing 5. The application of an external load to the shaving assemblies 15, 16 enables them to recede against the force of the compression springs 17, 18 in dependence upon the applied load. When this receding motion takes place without superimposition of a pivotal motion of the shaving head housing 5, the associated followers 24 of the control levers 21 and 22, respectively, are moved downwardly in accordance with the receding motion, so that the opposite lever arm is able to lift itself clear of the follower arm 28 of the corresponding control slide 26, 27. The receding motion of the shaving assemblies 15, 16 is thus not restricted by the control levers 21, 22 and the control slides 26, 27. In this arrangement, the receding motion can be performed not only as a parallel displacement of the shaving assemblies, but rather, a more pronounced receding motion of one side enables a tilting motion to be performed about an axis extending in a direction transverse to the longitudinal direction or direction of oscillation (double arrow 14) of the shaving assemblies.

However, when the shaving head housing 5 is pivoted with respect to the housing 1 or the holding arms 11 as shown in FIGS. 3 and 5, the leading shaving assembly, as seen looking in the pivot direction, is lowered relative to the shaving head housing 5 as described in the following. FIGS. 3 and 5 show the shaving head housing 5 pivoted relative to the shaver housing in clockwise direction. This causes the shaving assembly 15 to be lowered which on such a pivotal movement is the leading one in the pivot direction. As a result of the pivotal movement described, the control slide 26 is pushed upwardly by the control trunnion 29, while the control slide 27 is disengaged from the control trunnion 30. The lifting motion of the control slide 26 in turn causes the control lever 21 to pivot about the pivot bearing 23, as a result of which the follower 24 and with it the shaving assembly 15 coupled to it is moved downwardly by distance d (see FIG. 5). This downward movement of the shaving assembly 15 occurs in opposition to the biasing force of the compression spring 17, whereby the retracting stroke usable in this pivot condition is correspondingly reduced by an external load applied as the case may be. The full retracting stroke continues to be available to the shaving assembly 16. It is solely owing to this lowering of the shaving assembly 15 as illustrated in FIGS. 3 and 5 that the angular position of a tangent to both shaving assemblies 15 and 16 varies by angle w (see FIG. 3). This angle w is added to the pivot angle between the housing 1 and the shaving head housing 5 as defined by the center lines S and G of the shaving head housing and the shaver housing, respectively.

In other terms, pivoting of the shaving head housing 5 serves to adjust the maximum extension of the shaving assemblies 15, 16. As seen in the example of FIG. 5, the maximum extension position, when pivoted, is reduced by the distance d from the maximum extension position, when in the mid-position (FIG. 4). Consequently, the interaction of the control levers 21, 22, the control slides 26, 27 and the trunnions 29, 30 control a maximum degree of extension of the respective shaving assemblies 15, 16 as a function of a pivot angle between the housing 1 and the shaving head housing 5.

The lowering of the shaving assembly 15 by the control slide 26 and the control lever 21 causes a compression of the compression spring 17 as a result of which the shaving head housing 5, in the absence of the load responsible for the pivotal movement of the shaving head, locates itself automatically back into its mid-position under simultaneous relaxation of the compression spring 17.

Figure 6:
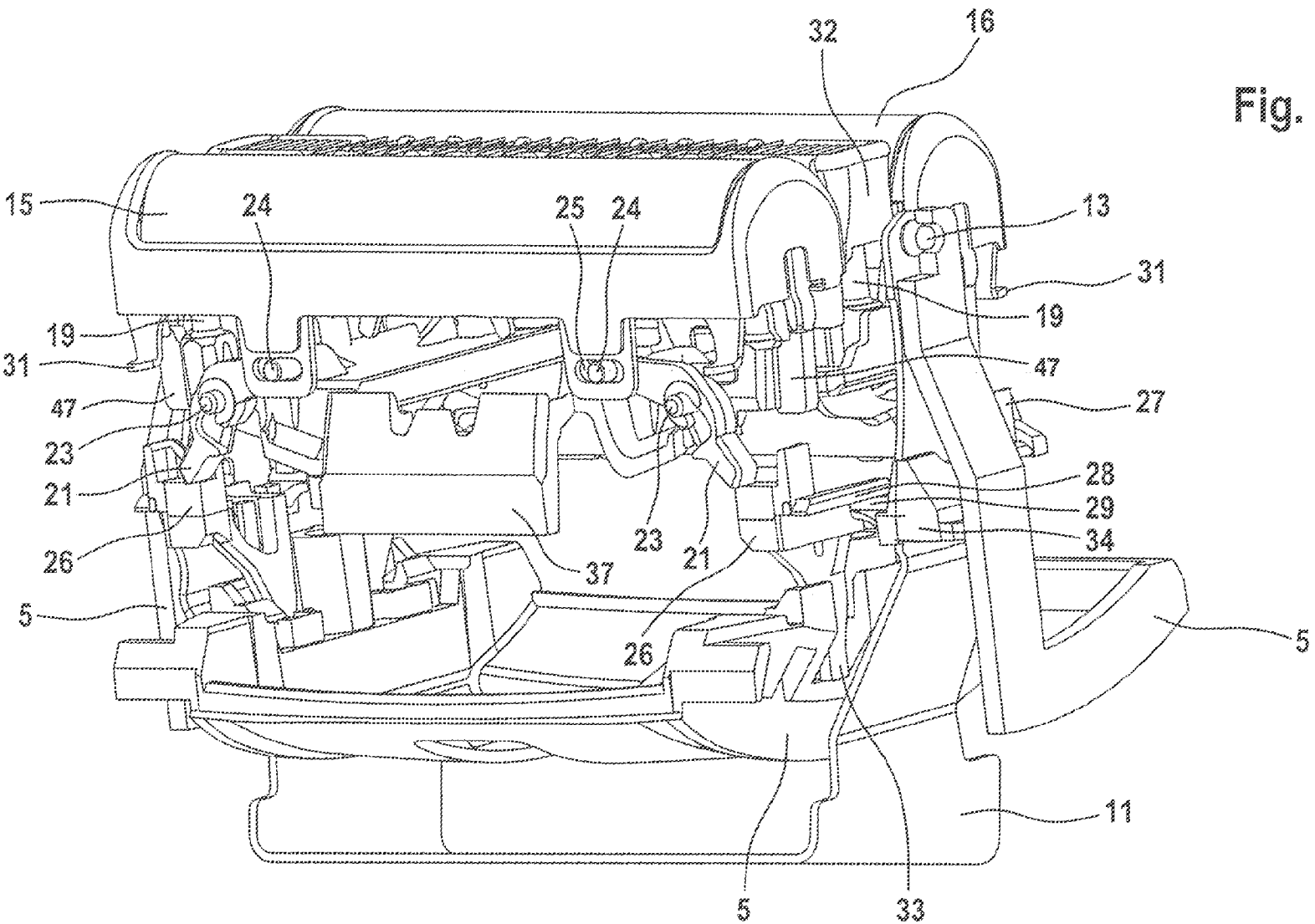
FIGS. 6 to 7 are views of the shaving head of a shaver of the invention illustrating three shaving assemblies in different pivotal positions.

FIG. 6 shows in a perspective view a shaving head with three shaving assemblies in a mid-position. In the following, the reference numerals used in the preceding description of FIGS. 1 to 5 will continue to be used for like parts. Arranged in the substantially cut away shaving head housing 5 which is pivotally connected to the holding arms 11 by the bearing point 13 are two shaving assemblies configured as foil shaving assemblies 15 and 16 which embrace between them a long-hair trimmer assembly 32 aligned in the same longitudinal direction. The long-hair trimmer assembly 32 includes two comb-type shearing elements known in the art, which are driven to oscillate relative to each other. All three shaving assemblies 15, 16 and 32 are floating-mounted, each by two guide bolts 19, in the exchangeable frame 37 held in the shaving head housing 5 and are biased in upward direction by compression springs not illustrated in the figure, which, as the case may be, are arranged in the exchangeable frame 37.

As explained in the foregoing with reference to FIGS. 2 to 5, the two shaving assemblies 15 and 16 are mounted in the shaving head housing 5 or in the exchangeable frame 37 and controlled by suitable kinematic elements. As shown in FIG. 6 for the shaving assembly 15 in particular, it is mounted on two guide bolts 19 which are arranged in the area of the longitudinal end sections of the shaving assembly. To permit tilting of the shaving assemblies 15, 16, 32, they are mounted on their two guide bolts 19 in fixed relation at the one end and in loose relation at the other end. To prevent the shaving assemblies 15, 16, 32 from rolling (rotation about the longitudinal axis), their ends are provided with a vertically extending slot which receives a respective rib 47 serving to guide the associated shaving assembly. Two control levers 21 engage with their followers 24 in elongated holes 25 of the shaving assembly 15, with the control levers themselves being pivotally mounted in the exchangeable frame 37 by respective pivot bearings 23. Accordingly, part of the actuating elements, namely the control levers, 21, 22, is arranged in the exchangeable frame 37 while another part, namely the control slides 26, is arranged in the shaving head housing. When the exchangeable frame 37, which is a wearing part, is replaced, it is therefore not necessary to replace the entire actuating device. Because the shaving assembly 15 is biased in upward direction, the arm of the control lever 21 opposite the follower 24 rests against a control slide 26. The control slides 26 are vertically slidably mounted. To this effect, their downwardly pointing end is configured to include a rod-shaped guide rail 33. The bar-shaped follower arms 28 of the control slides 26 can be acted upon by the control trunnions 29, which are integrally formed on a support 34 embracing the holding arm 11 at least in part and being therefore secured to it.

The structural design described in the foregoing applies by analogy also to the shaving assembly 16 with its corresponding components explained with reference to FIGS. 2 to 5, in which the control trunnions 30 capable of acting upon the control slides 27 are likewise provided on the support 34. Serving as stops 31 for limiting the vertical upward movement of the shaving assemblies 15 and 16 are arms formed on the shaving assemblies, which arms are adapted to abut associated stops, not illustrated, within the exchangeable frame 37.

Figure 7:
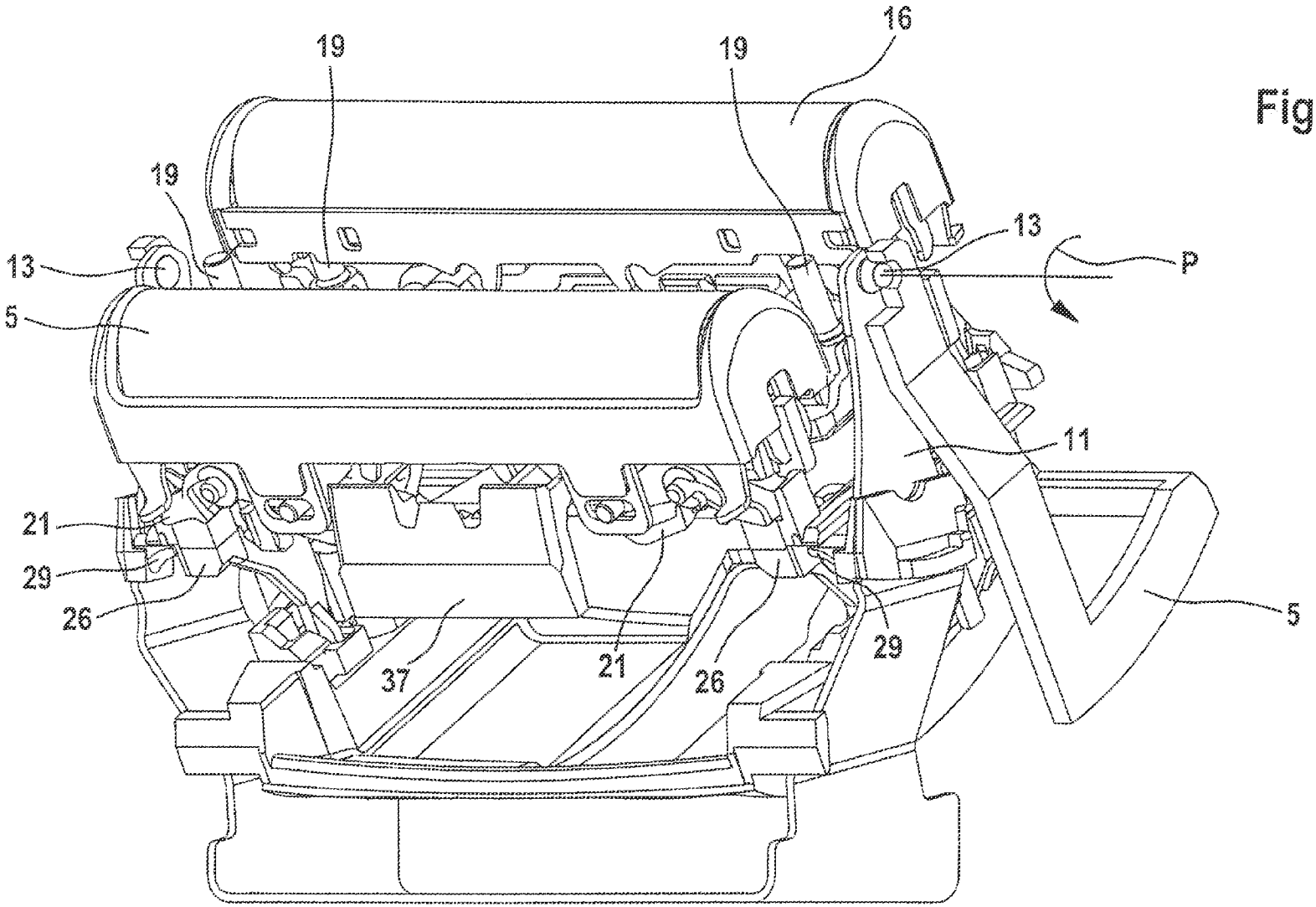

FIG. 7 shows a pivoted position of the shaving head housing 5 with respect to the shaver housing 1 or the holding arms 11 in accordance with the direction of rotation P. As this pivoting movement proceeds, the control slides 26 are acted upon by the control trunnions 29 such as to cause them to be displaced upwardly. As a result, the shaving assembly 15 is pressed downwardly by the simultaneous pivotal motion of the two control levers 21. The long-hair trimmer assembly 32 includes arms, not shown, which protrude laterally with respect to the shaving assemblies 15, 16 and embrace the undersides thereof. During the downward movement of the shaving assembly 15 imposed by the control levers 21 (or on a pivotal movement in opposition to the direction P of the shaving assembly 16), the long-hair trimmer assembly is thereby caused to follow this downward movement after the play is overcome. This ensures that upon lowering the outer shaving assembly 15 or 16 the long-hair trimmer assembly 32 does not protrude beyond a shared tangent applied to the arched shaving assemblies 15 and 16. Any such protrusion of a long-hair trimmer assembly 32 would be detrimental to a gentle skin treatment during the shaving operation.

While a number of examples have been described for illustration purposes, the foregoing description is not intended to limit the scope of the invention, which is defined by the scope of the appended claims. There are and will be other examples and modifications within the scope of the following claims.

What is claimed is:

1. An electric shaver, comprising:

a shaver housing;

a shaving head housing that is connected to the shaver housing for pivotal movement between two end positions, and that carries at least two shaving assemblies, of which at least one shaving assembly is retractable into the shaving head housing to a first, retracted position, and elastically biased toward a second, extended position, such that extension of the at least one shaving assembly is a function of contact pressure applied by a user; and actuating elements carried by the shaving head housing that control a maximum degree of extension of the at least one shaving assembly relative to the shaving head housing as a function of a pivot angle between the shaver housing and the shaving head housing.

2. The shaver of claim 1, wherein the at least one shaving assembly is moved by the actuating elements at least partly towards the retracted position, when the at least one shaving assembly is a leading shaving assembly relative to a pivot direction.

3. The shaver of claim 1, wherein the at least two shaving assemblies have respective longitudinal axes extending parallel to one another and parallel to a pivotal axis of the shaving head housing, with the shaving assemblies being configured as linearly oscillating assemblies, wherein oscillation occurs along the respective longitudinal axes.

4. The shaver of claim 1, wherein the at least two shaving assemblies are floating-mounted in the shaving head housing.

5. The shaver of claim 1, wherein the at least two shaving assemblies each include an outer cutter and an under cutter biased into contact therewith.

6. The shaver of claim 1, wherein the actuating elements include at least one pivotable control lever that pivots in response to a pivotal movement of the shaving head housing relative to the shaver housing.

7. The shaver of claim 6, wherein a first arm of the control lever is acted upon by a stop, and a second arm of the control lever is coupled to at least one of the shaving assemblies.

8. The shaver of claim 1, wherein the at least one shaving assembly acts on another shaving assembly during at least a portion of a retraction stroke.

9. The shaver of claim 1, wherein the shaving head housing is lockable at a defined pivot angle with respect to the shaver housing.

10. The shaver of claim 9, wherein the defined pivot angle is a maximum pivot angle.

11. The shaver of claim 1, wherein the shaving assemblies are arranged in an exchangeable frame adapted to be locked with the shaving head housing.

12. The shaver of claim 1, further comprising an exchangeable frame that is connectable to the shaving head housing, wherein the shaving assemblies are displaceably mounted in the exchangeable frame.

* * * * *